US009167868B1

(12) United States Patent
Koo

(10) Patent No.: US 9,167,868 B1
(45) Date of Patent: Oct. 27, 2015

(54) SHOE WITH EMBEDDED STRAP ANCHOR

(75) Inventor: John C. S. Koo, Los Angeles, CA (US)

(73) Assignee: Dynasty Footwear, Ltd., El Segundo, CA (US)

( * ) Notice: Subject to any disclaimer, the term of this patent is extended or adjusted under 35 U.S.C. 154(b) by 2304 days.

(21) Appl. No.: 12/098,814

(22) Filed: Apr. 7, 2008

Related U.S. Application Data

(60) Provisional application No. 60/910,652, filed on Apr. 7, 2007, provisional application No. 60/915,924, filed on May 3, 2007.

(51) Int. Cl.
*A43B 7/22* (2006.01)
*A43C 11/00* (2006.01)
*A43C 1/00* (2006.01)

(52) U.S. Cl.
CPC .. *A43C 1/00* (2013.01); *A43C 11/00* (2013.01)

(58) Field of Classification Search
CPC ..... A43C 1/00; A43C 1/03; A43C 11/00; A43B 7/142; A43B 7/144; A43B 23/072
USPC ..... 36/103, 91, 12, 50.1, 58.5, 58.6
See application file for complete search history.

(56) References Cited

U.S. PATENT DOCUMENTS

| | | | | |
|---|---|---|---|---|
| 2,245,706 | A | 6/1941 | Nutt | |
| 2,297,594 | A | 9/1942 | Weinstat | |
| 2,297,595 | A | 9/1942 | Weinstat | |
| 2,368,314 | A | 1/1945 | Marx | |
| 2,434,024 | A | 1/1948 | Vlasak | |
| 2,538,170 | A | 1/1951 | Stritter | |
| 4,622,763 | A * | 11/1986 | Adams | 36/50.1 |
| 4,635,383 | A * | 1/1987 | Free | 36/7.6 |
| 5,271,130 | A * | 12/1993 | Batra | 24/714.6 |
| 5,377,430 | A * | 1/1995 | Hatfield et al. | 36/51 |
| 5,497,564 | A * | 3/1996 | Allen et al. | 36/50.1 |
| 5,526,585 | A * | 6/1996 | Brown et al. | 36/50.1 |
| 5,732,483 | A * | 3/1998 | Cagliari | 36/115 |
| 5,991,950 | A | 11/1999 | Schenkel | |
| 6,029,376 | A * | 2/2000 | Cass | 36/50.1 |
| D475,180 | S * | 6/2003 | Cosentino | D2/896 |
| 7,343,701 | B2 * | 3/2008 | Pare et al. | 36/50.1 |
| 7,500,323 | B2 * | 3/2009 | Rasmussen | 36/50.1 |
| 7,685,740 | B2 * | 3/2010 | Sokolowski | 36/8.3 |

(Continued)

FOREIGN PATENT DOCUMENTS

| | | |
|---|---|---|
| EP | 0329392 | 8/1989 |
| GB | 428127 | 4/1935 |

*Primary Examiner* — Jila M Mohandesi
(74) *Attorney, Agent, or Firm* — Joseph G. Swan, P.C.

(57) ABSTRACT

Provided are, among other things, shoes, portions of shoes and processes for manufacturing the same. According to one embodiment, a shoe includes: a sole comprised of a base material and a strap anchor, the strap anchor being stronger than the base material, including a number of attachment points on opposite sides of the shoe, and being at least partially embedded within the base material; and a strap that is attached to and/or looped through at least one of the attachment points and that is configured for strapping the shoe to a wearer's foot. According to another embodiment, a shoe includes: a sole comprised of a base material and a strap anchor, the strap anchor including a number of attachment points on opposite sides of the shoe, and the base material having been injection molded around the strap anchor; and a strap that is attached to and/or looped through at least one of the attachment points and that is configured for strapping the shoe to a wearer's foot.

18 Claims, 6 Drawing Sheets

(56) References Cited

U.S. PATENT DOCUMENTS

| | | | | |
|---|---|---|---|---|
| 2004/0250452 | A1* | 12/2004 | Farys | 36/89 |
| 2005/0278980 | A1* | 12/2005 | Berend et al. | 36/103 |
| 2006/0130363 | A1* | 6/2006 | Hottinger | 36/28 |
| 2006/0196080 | A1 | 9/2006 | Kelley | |
| 2007/0011914 | A1* | 1/2007 | Keen et al. | 36/50.1 |
| 2007/0068041 | A1* | 3/2007 | Farys | 36/50.1 |
| 2008/0040949 | A1 | 2/2008 | Moseley | |
| 2008/0052964 | A1 | 3/2008 | Taylor | |

* cited by examiner

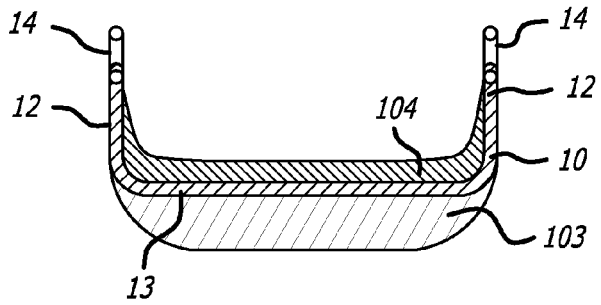
FIG. 3
FIG. 4
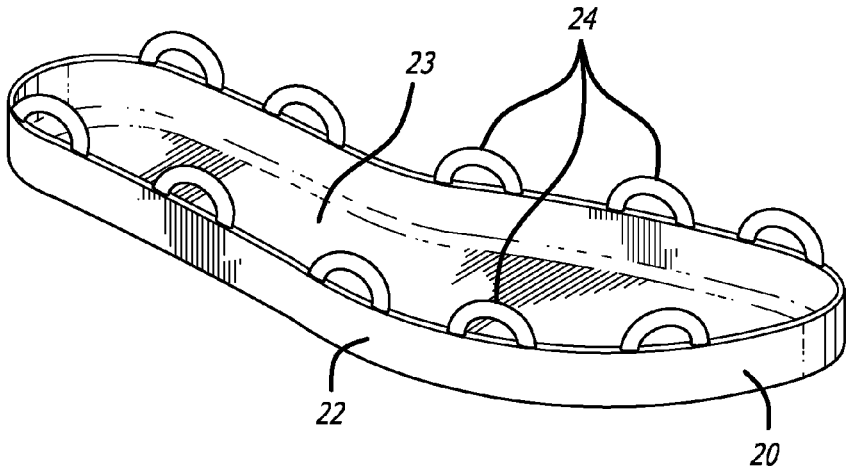
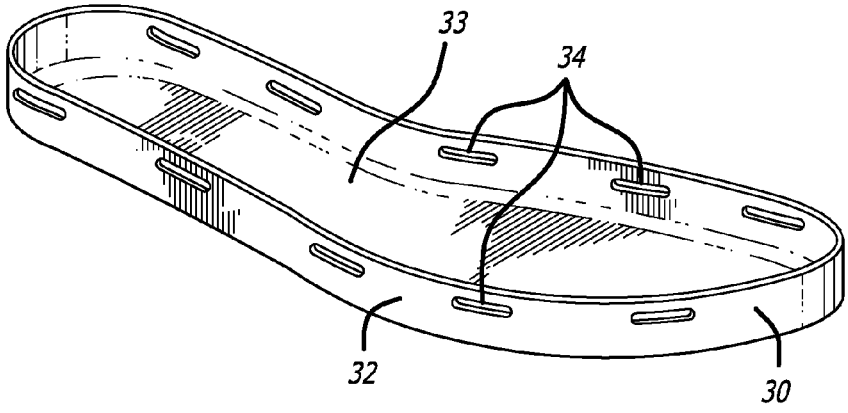
FIG. 5

FIG. 10
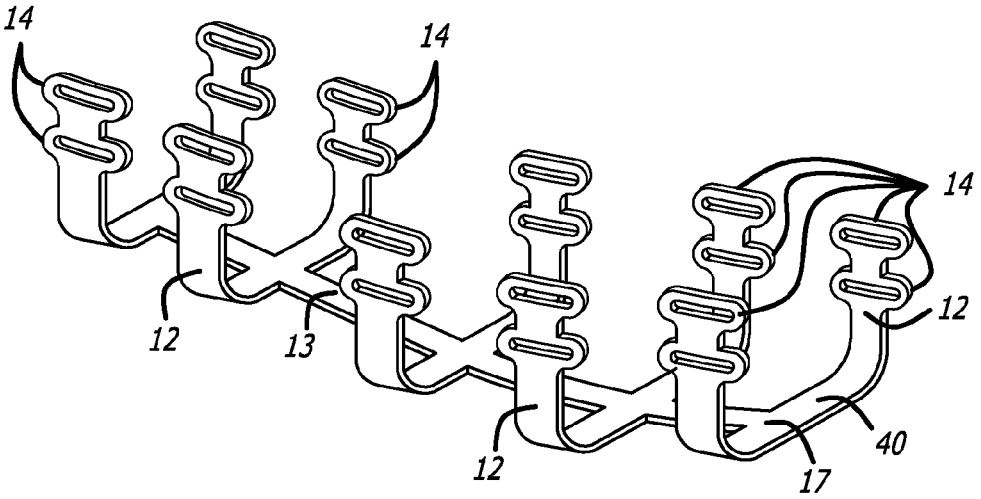
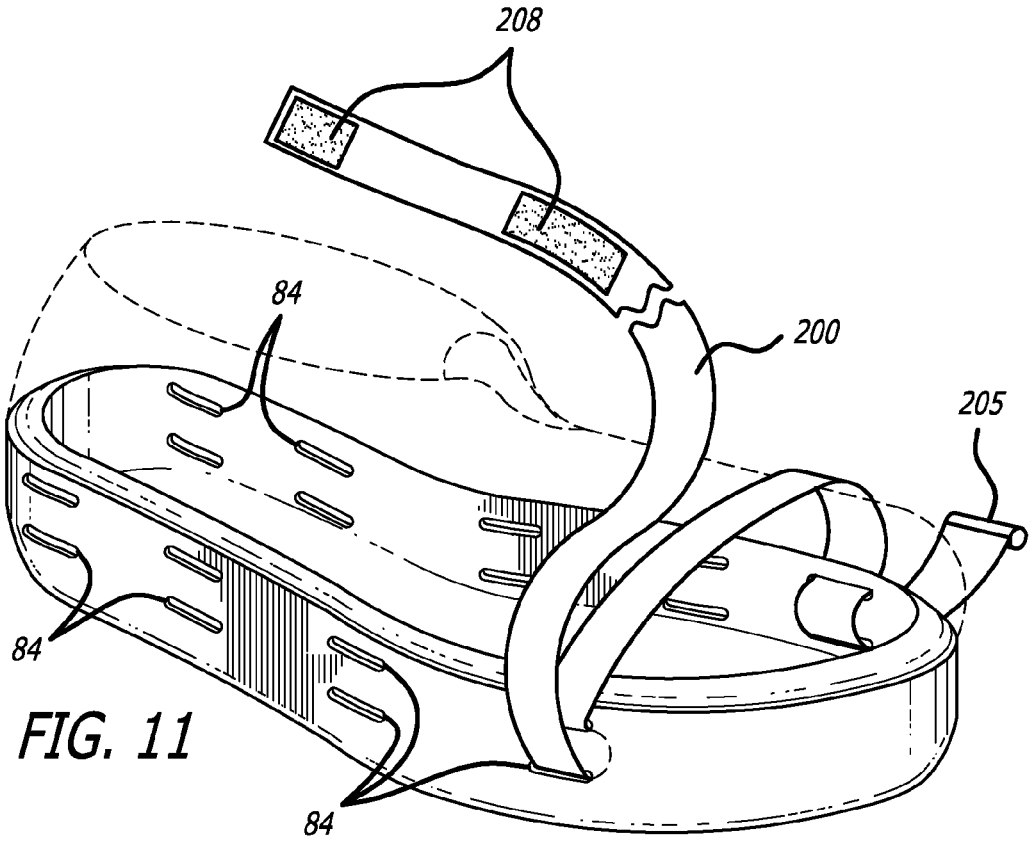
FIG. 11

SHOE WITH EMBEDDED STRAP ANCHOR

This application claims the benefit of U.S. Provisional Patent Application Ser. No. 60/910,652, filed on Apr. 7, 2007, and titled "Embedded Strap Anchor", and U.S. Provisional Patent Application Ser. No. 60/915,924, filed on May 3, 2007, and also titled "Embedded Strap Anchor", which applications are incorporated by reference herein as though set forth herein in full.

FIELD OF THE INVENTION

The present invention pertains to shoes/footwear.

BACKGROUND

A variety of different kinds and styles of shoes exist. However, new and improved designs continuously are desirable.

SUMMARY OF THE INVENTION

The present invention addresses this need by providing a new kind of construction that uses one or more straps (e.g., flat nylon strap(s) or shoelace(s)) to secure the shoe to the wearer's foot. More specifically, an anchor for supporting such strap(s) is embedded within the shoe's sole (e.g., within a base material that forms the shoe's sole).

Thus, one embodiment of the invention is directed to a shoe that includes: a sole comprised of a base material and a strap anchor, the strap anchor being stronger than the base material, including a number of attachment points on opposite sides of the shoe, and being at least partially embedded within the base material; and a strap that is attached to and/or looped through at least one of the attachment points and that is configured for strapping the shoe to a wearer's foot.

Another embodiment is directed to a shoe that includes: a sole comprised of a base material and a strap anchor, the strap anchor including a number of attachment points on opposite sides of the shoe, and the base material having been injection molded around the strap anchor; and a strap that is attached to and/or looped through at least one of the attachment points and that is configured for strapping the shoe to a wearer's foot.

By virtue of the foregoing arrangements, it is, for example, often possible to provide shoes made of very lightweight materials that nevertheless include a durable strapping system.

The foregoing summary is intended merely to provide a brief description of certain aspects of the invention. A more complete understanding of the invention can be obtained by referring to the claims and the following detailed description of the preferred embodiments in connection with the accompanying figures.

BRIEF DESCRIPTION OF THE DRAWINGS

In the following disclosure, the invention is described with reference to the attached drawings. However, it should be understood that the drawings merely depict certain representative and/or exemplary embodiments and features of the present invention and are not intended to limit the scope of the invention in any manner. The following is a brief description of each of the attached drawings.

FIG. 3 is a front cross-sectional view of a shoe sole that has been assembled as shown in FIG. 1.

FIG. 4 is a perspective view of an alternate strap anchor 20 having a continuous sidewall 22, an overall shape that approximates the overall shape of the shoe's sole, and loops 24 extending above the sidewall 22.

FIG. 5 is a perspective view of another alternate strap anchor 30 having a continuous sidewall 32, an overall shape that approximates the overall shape of the shoe's sole, and slots 34 formed into the sidewall 32.

FIG. 10 illustrates a strap anchor 40 according to an alternate embodiment of the invention, in which pairs of slots 14 are provided.

FIG. 11 illustrates an example of a shoe sole having pairs of slots 84.

DESCRIPTION OF THE PREFERRED EMBODIMENT(S)

Figure 1:
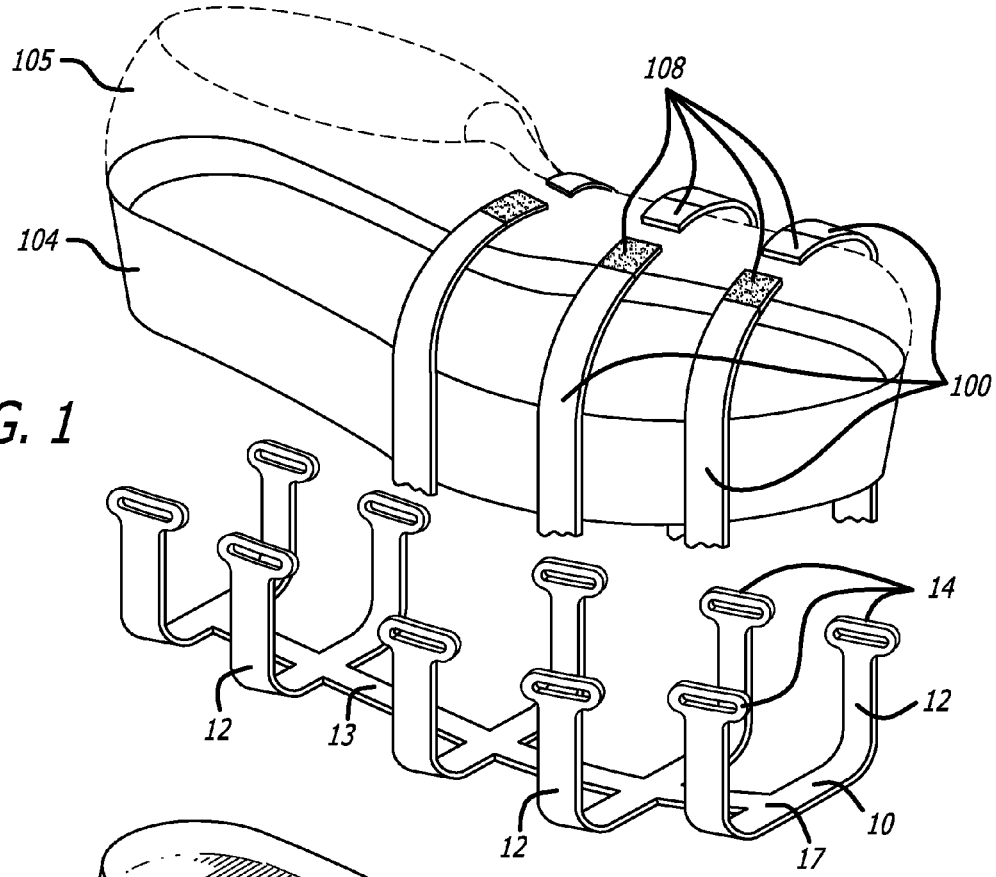
FIG. 1 is an exploded view of a shoe sole (with an upper 105 shown in phantom) in which a strap anchor 10, having a fishbone configuration with arms 12 extending from a main body portion 13 and terminating in loops 14, is bonded between layers 103 and 104 of a base material

The present disclosure is divided into sections, with the first section describing certain general aspects of a shoe, shoe sole and/or strapping system according to the present invention according to the present invention. The second section describes a bonding technique for manufacturing a shoe sole according to the present invention, as well as the resulting shoe sole. The third section describes a molding technique for manufacturing a shoe sole according to the present invention, as well as the resulting shoe sole. The fourth section describes certain alternate strapping configurations, and the fifth section describes certain additional considerations pertaining to the present invention.

General Discussion.

The present invention provides for a strap anchor (e.g., strap anchor 10, 20, 30 or 40) having a main body (or anchoring portion, e.g., anchoring portion 13, 23 or 33) that is embedded into, and therefore forms a part of, the sole of a shoe (or other item of footwear, collectively referred to as a "shoe" herein). In the preferred embodiments, the sole of the shoe is made of a very lightweight base material, such as a natural or synthetic material (e.g., any of the materials mentioned below) that has been "blown" with air while in liquid or semi-liquid form, thereby creating a number of small air pockets, so as to make the material more cushiony and less dense. Alternatively, or in addition, a mixture of different compounds or other materials may be used so as to increase or decrease the overall density (e.g., with different compounds blended together so that each is indistinguishable from the others, with pieces of less dense cushioning material mixed in but retaining their separate identities, and/or with pieces of less desirable material, such as recycled rubber or other recycled material, mixed in but retaining their separate identities). The upper of the shoe (if any), other than any straps for tightening the shoe, preferably also is made of a very lightweight material, such as a "blown" natural or synthetic material.

The strap anchor (e.g., strap anchor 10, 20, 30 or 40), on the other hand, preferably is made of a stronger and more durable material than that of the base material for the shoe's sole or the material from which the shoe's upper is fabricated. Examples of such materials include any combination of: a fiberglass or fiber-wrapped pre-shaped board, a high-durometer ethylene vinyl acetate (EVA), polyvinyl chloride (PVC), thermoplastic rubber (TPR), or any other plastic, natural or synthetic rubber or polymer. In the preferred embodiments, in order to reduce manufacturing costs, the strap anchor (e.g., strap anchor 10, 20, 30 or 40) is manufactured as a unitary piece from a single type of material. However, in alternate embodiments, the strap anchor is assembled from different pieces (e.g., glued or bonded together for molding), and/or different kinds of materials are used to fabricate the strap anchor, e.g., a stronger, harder or more rigid material for the strap-attachment points (e.g., strap-attachment points 14, 24 or 34), such as metal rings or hooks, than is used for the anchoring portion 13, 23 or 33.

With reference to strap anchor 10 as an example, in a representative embodiment the anchoring portion 13 of the strap anchor 10 has a central elongated backbone section (e.g., in the shape of an elongated rectangle) from which a number of projections or arms 12 extend at approximately right angles from its sides, so that the entire strap anchor 10 resembles a fish skeleton. Such a fishbone structure often will provide additional structural integrity to the rest of the sole. It is noted that the number and configuration of arms 12 shown in FIG. 1 is merely exemplary; any other number and configuration of arms 12 instead may be used. For instance, the arms 12 may be selectively designed to apply structural support as desired and/or to ensure that the strap-attachment points 14 are appropriately positioned for desired strapping pressure points. With regard to the former, it is noted that the arms 12 may be used as a part of the shoe's upper 105 (e.g., to assist in holding the upper onto the wearer's foot).

Alternatively, with reference to strap anchor 20 or 30 as an example, in an alternate embodiment the anchoring portion (or main body) of the strap anchor (i.e., anchoring portion 23 or 33, respectively) is configured as a substantially solid piece, e.g., having a shape that at least roughly matches the shape of the shoe's sole. In still further embodiments, the anchoring portion of the strap anchor may have any other configuration.

Also, the anchoring portion 13, 23 or 33 (or, more generally, the entire strap anchor 10, 20, 30 or 40) may be provided with other structural characteristics that are desirable for the particular shoe being manufactured. For example, the front portion 17 of strap anchor 10 may be thicker, broader, wider, fabricated from a stronger and/or more rigid material, or otherwise stronger and/or more rigid, so as to provide additional toe strength and/or support for the resulting shoe. In one such representative embodiment, the front portion 17 of the anchoring portion 13 of strap anchor 10 (or, e.g., the front portion of the entire strap anchor 10, 20, 30 or 40) includes a strong and/or rigid toe cap (e.g., made of Kevlar™ or another strong material). As a result, a very lightweight climbing shoe or work shoe can be made. Similarly, anchoring portion 13, 23 or 33 may be provided with a stronger and/or more rigid rear portion to protect the wearer's heel.

In addition to its anchoring portion, e.g., 13, 23 or 33 (i.e., the portion that is embedded within the shoe sole's base material), the strap anchor (e.g., strap anchor 10, 20, 30 or 40) also has a number of hooks, loops, slots or other strap-attachment points (e.g., loops 14 or 24 or slots 34) that extend up from the sole on the left and right sides thereof. In the preferred embodiments, the entire structure of the strap anchor (e.g., strap anchor 10, 20, 30 or 40) is rigid, semi-rigid or at least shape-retaining.

Conventional shoes made entirely of lightweight material generally have been limited to sandals and other slip-on shoes because they are not capable of withstanding the stresses that would result from using straps, laces or other tightening mechanisms. However, by using a strap anchor according to the present invention (with its main body, e.g., anchoring portion 13, 23 or 33, embedded within the shoe's sole) and by securing one or more straps (e.g., straps 100 or single strap 200) to the upper strap-attachment points (e.g., strap-attachment points 14, 24 or 34) of the strap anchor (e.g., strap anchor 10, 20, 30 or 40), the entire shoe can be tightened without imposing any significant stress on the main body of the shoe (sole or upper). Instead, most or all of the stress preferably is imparted to the strap anchor (e.g., strap anchor 10, 20, 30 or 40). As a result, in certain embodiments the user can have the feel of a very lightweight shoe while still having the benefit of being able to securely strap the shoe to his or her foot. It is noted that the strap-attachment points 14, 24 or 34 preferably are selectively positioned so that the straps (e.g., straps 100 or single strap 200) cross the wearer's foot and provide pressure at appropriate locations.

Preferably, the straps themselves (e.g., straps 100 or single strap 200) are made of a strong durable material. Examples include nylon, natural or synthetic rubber, string or the like; alternatively, ordinary shoelaces may be used.

Bonding Construction.

Figure 2:
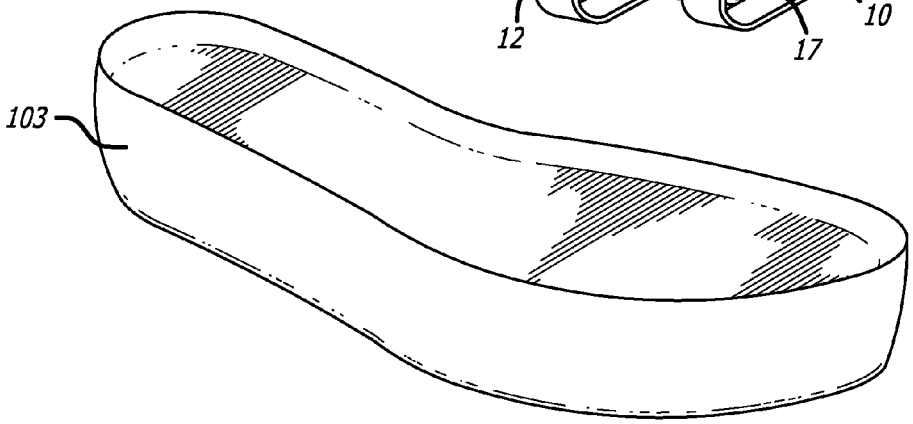
FIG. 2 is a perspective view of a shoe sole that has been assembled as shown in FIG. 1.
Figure 2:
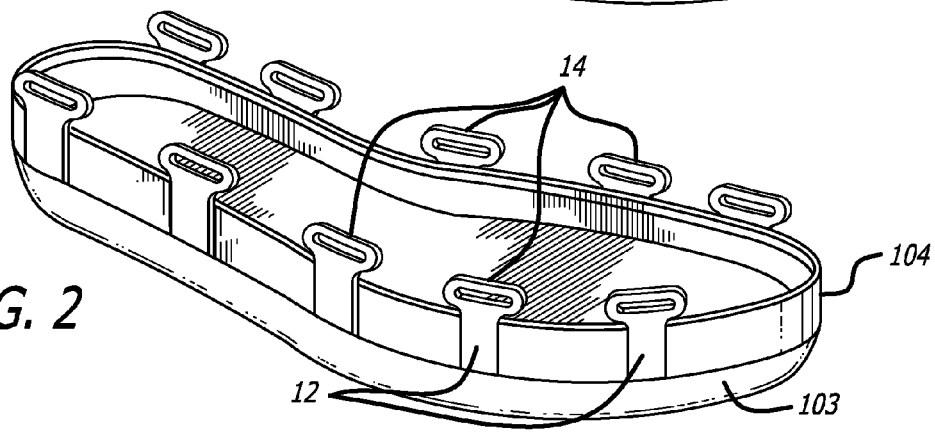

In one representative embodiment, an example of which being illustrated in FIGS. 1 and 2, the anchor portion 13 of the strap anchor 10 is inserted into the shoe's sole by gluing or otherwise bonding it in between two layers 103 and 104 of the sole's base material, with the arms 12 (which terminate in strap-attachment points 14) extending out and up from the sides of the sole. In this embodiment, the strap-attachment points 14 of the strap anchor 10 typically will extend along the outside perimeter of the top portion of the shoe's sole and, unless separately coated with material to match the sole's base material (i.e., the material forming layers 103 and 104), typically will have a different appearance and/or texture than the shoe's sole.

Once a shoe sole has been assembled in this manner, an upper 105 may be bonded to it. Alternatively, the upper 105 may already have been attached to layer 104, so that the entire shoe is completed upon bonding strap anchor 10 in between layers 103 and 104. Still further, the upper previously may have been attached to strap anchor 10 (e.g., by stitching, gluing and/or otherwise bonding), so once again the entire shoe is completed upon bonding strap anchor 10 in between layers 103 and 104. Finally, a separate upper 105 may be omitted entirely. In any event, a strapping system preferably is used for tightening the resulting shoe. In the embodiment shown in FIG. 1, multiple individual straps 100 are provided and the proximal end of each is attached at some point during the manufacturing process to one of the strap-attachment points 14, such as by looping its proximal end through a strap-attachment point 14 and then sewing the end of strap 100 into a loop. In alternate embodiments, some examples of which being discussed in more detail below, some or all of the straps 100 do not fixedly attach to any of the strap-attachment points (e.g., strap-attachment points 14, 24 or 34), but instead merely loop through such strap-attachment points.

The distal end of each strap 100 preferably is provided with an attachment mechanism 108, such as a high-density hook-and-loop mechanism (e.g., as is commonly sold under the brand name Velcro™), a clip mechanism, a hook mechanism, a belt-tightening mechanism or any other attachment mechanism. Alternatively, an attachment mechanism 108 may be omitted entirely, so that the user simply ties the distal ends of opposing straps 100 (e.g., where straps 100 are shoelaces). In the present embodiment, individual straps 100 attach (e.g., permanently) to strap-attachment points (e.g., strap-attachment points 14, 24 or 34) on opposite sides of the shoe and then opposite straps are pulled together and secured (e.g., using the provided attachment mechanism) in order to effect the desired tightening. However, it should also be noted that any other kind of strapping arrangement instead may be used, such as the use of strap 200, described below.

In the event that a separate upper (e.g., upper 105) is provided, the straps preferably go over the top of the upper, thereby securing the wearer's foot to both the shoe's upper and to its sole. For this purpose, the strap(s) may be threaded through slits or other openings in the upper, or the strap(s) may simply extend across the top of the upper without engaging it. Otherwise, e.g., in the case of a sandal, the straps may simply rest on the top of the sole when not in use, and then the wearer simply slips his or her foot beneath the straps and then tightens the straps to secure his or her foot to the shoe.

Although strap anchor 10 is shown in FIGS. 1-3, either of strap anchor 20 (shown in FIG. 4) or strap anchor 30 (shown in FIG. 5), or any other configuration of strap anchor, may be substituted for strap anchor 10 in this embodiment of the invention. In fact, the front cross-sectional view of the shoe sole generally will have the same appearance shown in FIG. 3 irrespective of which of strap anchors 10, 20, 30 or 40 is used.

The simple bonding procedure (shown in FIGS. 1-3) has the advantage that no special equipment generally is required. However, one characteristic of this construction is that the arms 12 (or sidewall 22 or 32) typically will extend (and therefore be visible) along the outside of the upper layer 104 of the shoe's sole. In order to address this problem, lower layer 103 may be provided with upwardly extending sidewalls that cover arms 12 (or sidewall 22 or 32), or foxing may be bonded around the outer perimeter of the shoe's sole to cover arms 12 (or sidewall 22 or 32). Also, the arms 12 may be made very short, e.g., extending only slightly upwardly as part of the shoe's sidewall, so that it does not extend much (if at all) above the shoe's sole.

Other characteristics of this kind of construction are: (1) the existence of seams between the layers 103 and 104 and (2) as noted above, the fact that at least the strap-attachment points 14, 24 or 34 often will have a different appearance than the rest of the sole's base material. In this latter regard, it is noted that the strap-attachment points 14, 24 or 34 generally cannot be easily covered without interfering with their intended function; they can be coated, although that typically would require an additional manufacturing step, which typically also would impose additional cost.

Molding Construction.

Figure 6:
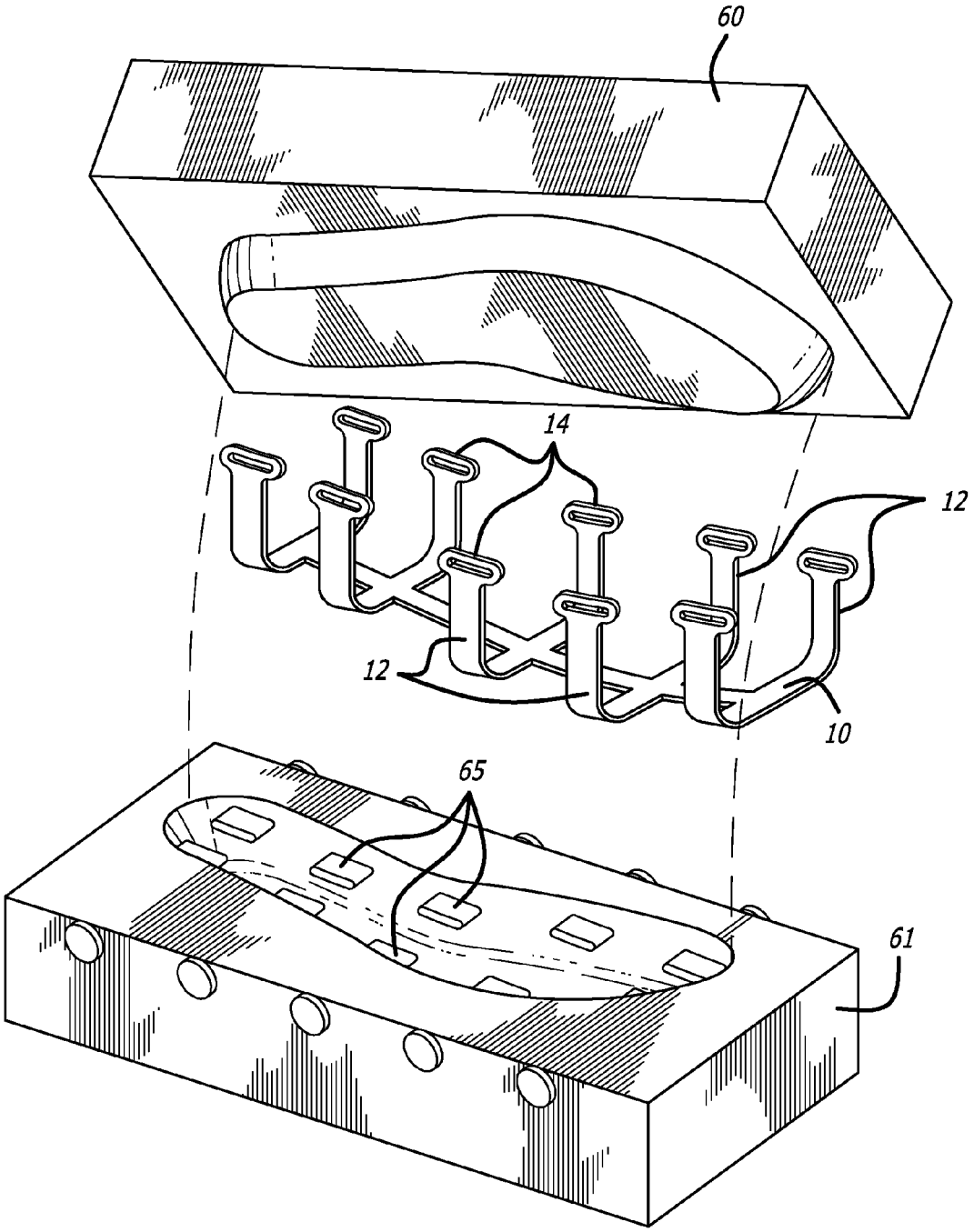
FIG. 6 is an exploded perspective view illustrating how an outsole can be molded with an embedded strap anchor 10.
Figure 7:
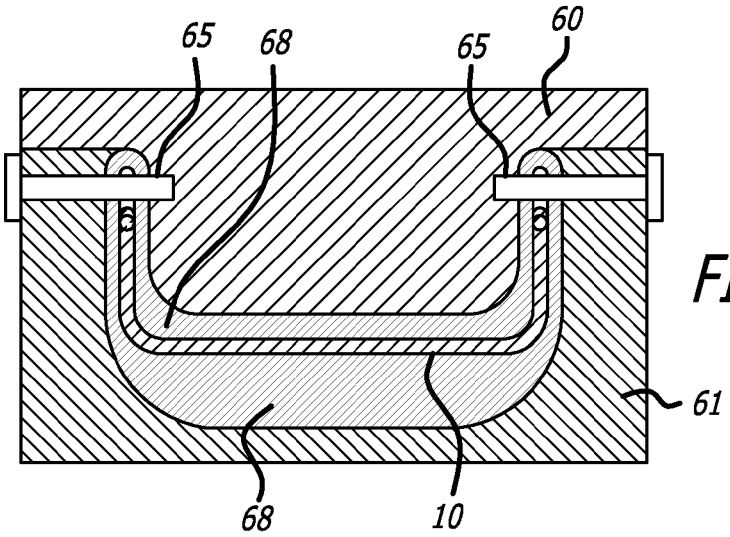
FIG. 7 is a front cross-sectional view showing strap anchor 10 installed within a shoe sole mold (comprising an upper portion 60 and a lower portion 61), with the shoe mold closed and with injection material 68 occupying the interior portion of the mold.

In an alternate embodiment, the anchor portion (e.g., anchoring portion 13, 23 or 33) of the strap anchor (e.g., strap anchor 10, 20, 30 or 40) is molded into the shoe's sole, e.g., by placing or suspending it into a mold and then injecting in the base material. An example of this embodiment is illustrated in FIGS. 6-7. In this embodiment, a mold is used to form the shoe's sole, the mold having an upper portion 60 and a lower portion 61. The mold (e.g., the lower portion 61 of the mold) preferably is provided with tabs 65 from which the strap anchor 10 is suspended using loops 14 (or using, e.g., whatever hooks, loops or slots are provided as strap-attachment points on the strap anchor).

As noted above, the strap anchor 10 preferably is shape-retaining so that it may be installed within the lower portion 61 of the mold by bending the arms 12 slightly inwardly and then fitting loops 14 onto tabs 65. In the preferred embodiments, tabs 65 fit snugly within loops 14. For this purpose, tabs 65 may be tapered, e.g., narrower at their distal ends and wider at their proximal ends, so that it is easy to initially install strap anchor 10 and then, by pressing the arms 12 toward the inner wall of lower portion 61, to obtain a secure fit.

In this manner, referring to FIG. 7 and bearing in mind that strap anchor 10 preferably is shape-retaining, the strap anchor 10 remains suspended within the lower portion 61 of the mold. Next, the mold is closed by attaching upper portion 60 to lower portion 61, and injection material 68 is injected into the mold. Ordinarily, the injection material 68 fills all portions of the inner cavity between upper portion 60 and lower portion 61 of the mold, completely surrounding and encasing strap anchor 10. Slots 65 serve the purpose of suspending strap anchor 10 within the mold while simultaneously ensuring that the loop openings 14 are not filled with the injection material 68.

By using this technique, the anchoring portion 13 of the strap anchor 10 is suspended within the shoe's sole during the injection process, so that it will be completely embedded and hidden from view in the final product. At the same time, the strap-attachment points 14 of the strap anchor 10 also will be coated with the same base material that is used to form the rest of the shoe's sole (other than a small area where each strap-attachment point 14 contacts the tabs 65 of the mold, i.e., on the underside of the top portions of the respective strap-attachment points 14, which area in any event is mostly hidden from sight). The result is a more uniform appearance for the shoe's sole and strap-attachment points 14 then is achieved with the bonding technique described above. In the present embodiment, strap-attachment points 14 typically appear to be a more integral feature of the shoe's sole.

Figure 8:
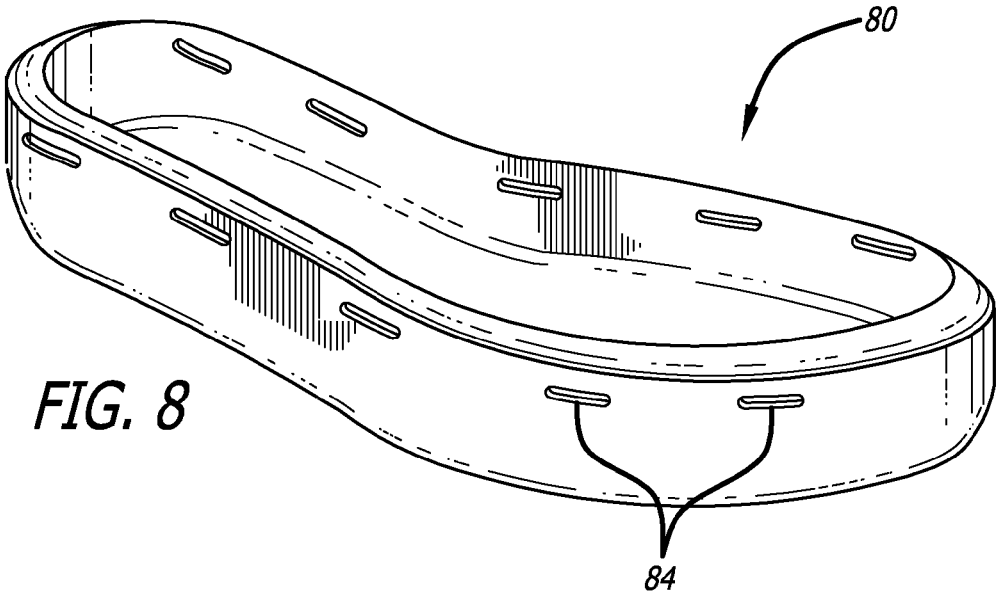
FIG. 8 is a perspective view of a shoe sole that has been made as shown in FIGS. 6 and 7.

An example of a shoe sole 80 that has been manufactured in accordance with this process is illustrated in FIG. 8. As shown, the sole 80 appears to be a single unitary piece with slots 84 that serve as strap-attachment points. Strap anchor 10 is completely hidden from view but provides a means for securely attaching a strapping system to the shoe.

All of the same considerations discussed above in connection with the bonding embodiment, with respect to the shape of the strap anchor 10, 20, 30 or 40 and/or the anchoring portion 13, 23 or 33 thereof, also apply with respect to the molding embodiment. In addition, it often is possible to achieve greater flexibility with the present molding technique. For example, when molding strap anchor 10, 20, 30 or 40 into the sole of a shoe, the strap anchor 10, 20, 30 or 40 can have a more or less arbitrary shape, with the injection material 68 simply filling in around the embedded portion of the strap anchor 10, 20, 30 or 40. Accordingly, additional structural support and/or reinforcement can be provided where and as desired, generally subject only to the requirement that the portion of the strap anchor 10, 20, 30 or 40 that is intended to be embedded actually fit within the shoe's sole. In contrast, in the bonding technique described above, the upper layer 104 and the lower layer 103 and generally need to be shaped to accommodate the shape of the corresponding anchoring portion 13, 23 or 33.

In addition, in certain embodiments in which the shoe's sole and its upper are molded together (e.g., using a two-piece mold), any portion of the arms 12 or sidewall 22 or 32 can be extended up into the shoe's upper, providing additional structural support and/or reinforcement as desired. At the same time, by molding the shoe's sole and/or upper around some or all of the strap anchor 10, 20, 30 or 40, it can be substantially or even completely hidden from view, thereby allowing a designer to achieve a wide range of aesthetic effects while still providing desired functional qualities. As noted above, such additional structural support can be used for manufacturing a work shoe or a shoe having specific technical requirements, such as a climbing shoe, a bicycling shoe or a river shoe.

Once the sole 80 has been completed, it can be attached to an upper, e.g., by gluing, otherwise bonding, or molding the upper onto the sole 80. Alternatively, by using an appropriately shaped (e.g., two-piece) mold, the upper and sole 80 may be molded together in a single operation (in which case the upper can be a different color or have different physical properties, if desired, by using a different injection material for the upper than is used for the sole). Still further, the upper may be stitched, glued or otherwise bonded to the strap anchor prior to molding the strap anchor into the shoe's sole. Finally, a separate upper may be omitted entirely in favor of just providing a strapping system, thereby resulting in a sandal or sandal-like shoe. In any event, straps (e.g., any of the straps described herein) preferably are used and attached to strap-attachment points 14 (either permanently or by simply looping them through). In the present embodiments, in which the strap anchor 10 is molded into the shoe's sole 80, the upper (if provided) preferably is made of the same material and has the same, similar or complementary color, design and aesthetic appearance as the shoe's sole 80.

It is noted that any kind of strap anchor may be molded into a shoe's sole in this manner. For example, strap anchors similar to anchor 20 (shown in FIG. 4) or anchor 30 (shown in FIG. 5) may be used. However, in such a case, the bottom surface of the corresponding anchoring portion 23 or 33 preferably is provided with slots or other kinds of openings in order to allow the injection material 68 to easily flow through and around the strap anchor 20 or 30, respectively.

It is further noted that, by appropriate layering or other known molding techniques, different kinds of base material can be injected to form the shoe's sole, e.g., one kind for the lower portion of the shoe's sole (e.g., the portion generally beneath the strap anchor) and another kind for the upper portion of the shoe's sole (e.g., the portion generally above the sole's upper). In this way, e.g., the sole can have a more durable bottom portion and a softer or more cushiony top portion (where the wearer's foot normally would rest), if desired. Also, by using appropriate molding techniques, the shoe's sole and/or upper can be formed with openings or holes, e.g., to allow ventilation.

In the embodiments described above, the strap anchor 10, 20, 30 or 40 is suspended in the mold using the corresponding strap-attachment points 14, 24 or 34. However, in alternate embodiments, the strap anchor is simply deposited into the mold or otherwise attached to the mold, e.g., using a mold having appropriate support nodules or the like. In such as case, portions of the strap anchor 10, 20, 30 or 40 generally will be exposed, e.g., within an indentation at the bottom of the shoe's sole, and either can be left exposed or can be covered, e.g., by bonding a plug into the indentation.

Still further, in a similar manner, a piece can be molded within the shoe's sole, even if the piece does not provide strap-attachment points. For example, such a piece might be used to provide the additional structural support or other functional benefits described above.

Alternate Strapping Configurations.

Figure 9:
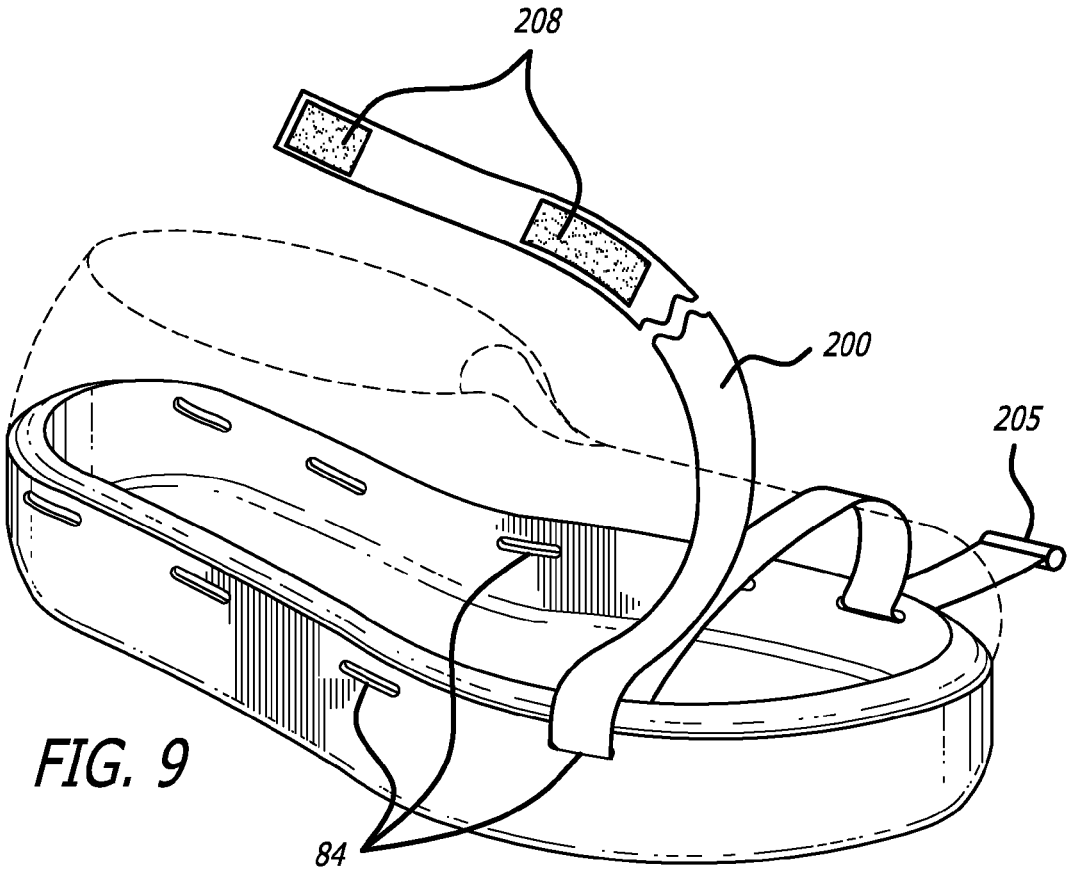
FIG. 9 illustrates an example of a strapping system that can be used in accordance with a shoe sole having an embedded strap anchor according to the present invention.

Referring to FIG. 9, one specific embodiment of the present invention uses a single removable strap 200 having an anchor 205 at one end and an attachment mechanism 208 (e.g., a high-density hook-and-loop attachment mechanism, such as is commonly sold under the brand name Velcro™) at the other end. Such a strap is described more fully in commonly assigned U.S. patent application Ser. No. 11/695,578 (the '578 application), which application is incorporated by reference herein as though set forth herein in full. In the embodiment illustrated in FIG. 9, the anchor 205 is an enlarged, preferably rigid element that prevents the strap 200 from being pulled through the first slot into which it is inserted. For that purpose, the slot against which anchor 205 abuts preferably is provided with a matching groove for accommodating anchor 205, e.g., so that anchor 205 does not protrude from the side of these shoe's sole.

Alternatively, anchor 205 may be implemented as an attachment mechanism, e.g., one that detachably attaches to the outer surface of the shoe's sole (e.g., a high-density hook-and-loop attachment mechanism). Once again, the area surrounding the slot against which such alternate attachment mechanism 205 abuts (e.g., a portion of the outer surface of the shoe's sole) may be grooved or otherwise indented to accommodate the attachment mechanism 205, e.g., so that the attachment mechanism 205 does not protrude.

In this embodiment, the removable strap 200 is looped from side to side through the strap-attachment points (e.g., strap-attachment points 84) of the strap anchor (e.g., embedded strap anchor 10, which is hidden from view in FIG. 9) and is used to tighten the shoe in a similar manner to that described in the '578 application. In the present embodiment, strap 200 has a high-density hook-and-loop attachment mechanism 208. However, in alternate embodiments any other kind of attachment mechanism 208 instead may be used (e.g., any of the other attachment mechanisms described herein).

It is noted that the shoe's strap(s) (e.g., 100 or 200) may be threaded through, otherwise removably attached to, permanently attached to, or completely unconnected to the rest of the shoe's upper. For example, slots may be provided in the upper to permit the strap 202 enter and exit the interior of the shoe (e.g., one for each of slots 84). The actual interaction between the shoe's strap(s) and the rest of the shoe's upper (if any), as well as whether any additional upper structure is provided at all, preferably depend mainly on aesthetic considerations, but in some cases on functional considerations as well. If an upper is provided, the strap 200 preferably passes over the top of the upper.

FIG. 10 illustrates a strap anchor 40 according to an alternate embodiment of the invention, in which a pair of vertically offset horizontal slots 14 is provided on each arm 12. Although the slots making up each such pair generally are illustrated as being horizontally aligned with each other, in alternate embodiments of the invention some horizontal offset is used (e.g., in order to guide the strap toward the next loop on the opposite side of the shoe). It is noted that strap anchor 40 can be embedded into a shoe's sole using either the bonding technique or the molding technique described above. In the latter case, the arrangement of tabs 65 preferably matches the arrangement of slots 14, at least with respect to those slots 14 that are not intended to be filled with injection material 68.

FIG. 11 illustrates an example of a shoe sole that has been manufactured by molding strap anchor 40 into the shoe's sole. As shown, the pairs of slots 84 allow the strap 200 to enter and exit the interior of the shoe (where a separate upper has been provided). In one of the embodiments discussed above, a similar result is achieved by using single slots in the strap anchor but including slots or other kinds of openings in the shoe's upper. The choice as to which approach to use preferably depends upon the expected stress that is to be imparted by the strap 200 and the strength of the upper material as compared to the material of the strap anchor that is used.

It is further noted that the strap anchor 40 is merely exemplary and any other configuration of strap anchor may be designed with similar pairs of closely spaced slots or loops, e.g., by modifying each of loops 24 to instead include a double loop or by modifying strap anchor 30 to have closely spaced pairs of slots 34.

More generally, the strap anchors described above should be understood as being merely exemplary. Various other configurations also may be used. For instance, rather than a single strap anchor, a plurality of U-shaped strap anchors, each terminating in a loop 14 at each of its ends, may be used; here, the effect would be similar to strap anchor 10, but omitting the central spine 13.

Once the shoe's sole has been completed, the shoe's strap(s) may be looped through, or attached to, the strap-attachment points. The rest of the upper (if any) is attached to the sole, e.g., by gluing or otherwise bonding it.

Additional Considerations.

Several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Similarly, in the discussion above, functionality sometimes is ascribed to a particular module or component. However, functionality generally may be redistributed as desired among any different modules or components, in some cases completely obviating the need for a particular component or module and/or requiring the addition of new components or modules. The precise distribution of functionality preferably is made according to known engineering tradeoffs, with reference to the specific embodiment of the invention, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A shoe, comprising:

a sole comprised of a base material;

a strap anchor, made of a second material that is stronger and more durable than the base material, including a plurality of attachment points on opposite sides of the shoe, and being embedded within the base material so as to be hidden from view, but with the attachment points accessible; and a strap that is at least one of attached to and looped through at least one of the attachment points and that is configured for strapping the shoe to a wearer's foot.

2. A shoe according to claim 1, wherein the attachment mechanism comprises at least one of a high-density-hook mechanism and a high-density-loop mechanism.

3. A shoe according to claim 1, wherein a front portion of the strap anchor is at least one of stronger and more rigid than other portions of the strap anchor.

4. A shoe according to claim 1, wherein a plurality of straps fixedly attach to different ones of the attachment points.

5. A shoe according to claim 1, wherein the base material has been injection molded around the strap anchor.

6. A shoe according to claim 1, wherein the base material has been blown with air so as to include a plurality of small air pockets.

7. A shoe according to claim 6, wherein the sole is made entirely of the base material.

8. A shoe according to claim 1, wherein the strap anchor comprises an elongated backbone section from which a plurality of projections extend.

9. A shoe according to claim 8, wherein a plurality of the projections terminate in the attachment points.

10. A shoe according to claim 9, wherein the elongated backbone is embedded within the sole.

11. A shoe according to claim 10, further comprising an upper extending above the sole and also made of the base material, and wherein the projections extend up into and are embedded within the upper.

12. A shoe according to claim 1, wherein the attachment points comprise at least one of loops and slots.

13. A shoe according to claim 1, wherein the strap anchor is a unitary piece.

14. A shoe according to claim 1, wherein the base material is a very lightweight material and the sole is made entirely of the base material.

15. A shoe according to claim 1, wherein the attachment points are disposed along an outside perimeter of a top portion of the sole.

16. A shoe according to claim 1, wherein the attachment points are just slightly above the sole.

17. A shoe according to claim 1, wherein the base material is a single kind of material.

18. A shoe according to claim 1, wherein the shoe has a main body structure that, other than the embedded strap anchor, is made entirely of a very lightweight material.

* * * * *